United States Patent [19]

Owen et al.

[11] 3,951,781

[45] Apr. 20, 1976

[54] COMBINATION PROCESS FOR SOLVENT DEASPHALTING AND CATALYTIC UPGRADING OF HEAVY PETROLEUM STOCKS

[75] Inventors: Hartley Owen, Belle Mead; Paul B. Venuto, Cherry Hill, both of N.J.

[73] Assignee: Mobil Oil Corporation, New York, N.Y.

[22] Filed: Nov. 20, 1974

[21] Appl. No.: 525,436

[52] U.S. Cl. ..... 208/86; 208/145; 208/153; 208/163; 208/309

[51] Int. Cl.[2] ..... C10G 13/18; C10G 34/07

[58] Field of Search ..... 208/86, 120, 128, 153, 208/163, 145, 309

[56] References Cited

UNITED STATES PATENTS

| | | | |
|---|---|---|---|
| 2,415,537 | 2/1947 | Schulze et al. | 208/128 |
| 2,700,637 | 1/1955 | Knox | 208/86 |
| 3,168,459 | 2/1965 | Anderson et al. | 208/120 |
| 3,617,496 | 11/1971 | Bryson et al. | 208/128 |
| 3,775,293 | 11/1973 | Watkins | 208/86 |
| 3,785,959 | 1/1974 | Bryson et al. | 208/120 |

*Primary Examiner*—Herbert Levine

*Attorney, Agent, or Firm*—Charles A. Huggett; Carl D. Farnsworth

[57] ABSTRACT

A raffinate product of residual oil solvent extraction is upgraded in a fluid zeolite catalyst cracking operation in the presence of one or more low molecular weight carbon-hydrogen fragment contributors. Gas oil products of atmospheric and vacuum distillation may be simultaneously converted by admixture with the raffinate charge. In addition the process is enhanced by the addition of straight run naphtha product of distillation with the raffinate charge.

10 Claims, 1 Drawing Figure

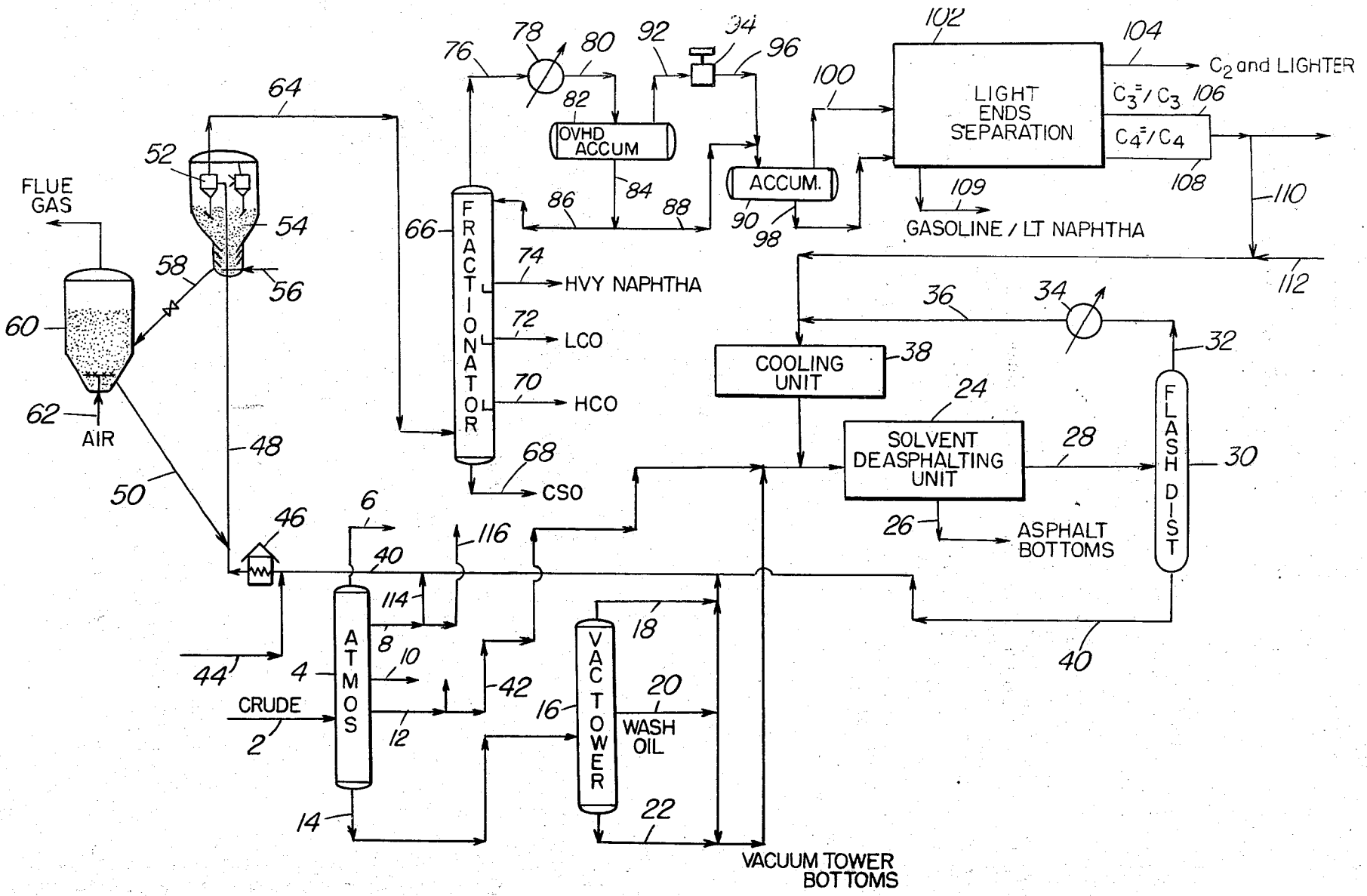
C2 and LIGHTER
C3=/C3
C4=/C4
LIGHT ENDS SEPARATION
GASOLINE / LT NAPHTHA
FLASH DIST
ASPHALT BOTTOMS
SOLVENT DEASPHALTING UNIT
COOLING UNIT
ACCUM.
OVHD ACCUM
HVY NAPHTHA
LCO
HCO
CSO
FRACTIONATOR
VACUUM TOWER BOTTOMS
WASH OIL
VACTOWER
ATMOS
CRUDE
FLUE GAS
AIR

COMBINATION PROCESS FOR SOLVENT DEASPHALTING AND CATALYTIC UPGRADING OF HEAVY PETROLEUM STOCKS

BACKGROUND OF THE INVENTION

It is known in the prior art to upgrade hydrogen deficient petroleum oils to more valuable products by thermal and catalytic cracking operations in admixture with a hydrogen donor diluent material. The hydrogen donor diluent is a material, aromatic-naphthenic in nature that has the ability to take up hydrogen in a hydrogenation zone and to readily release hydrogen to a hydrogen deficient oil in a thermal or catalytic cracking operation.

One advantage of a hydrogen donor diluent operation is that is can be relied upon to convert heavy oils or hydrogen deficient oils at relatively high conversions in the presence of catalytic agents with reduced coke formation. Coke as formed during the cracking operation is usually a hydrocarbonaceous material sometimes referred to as a polymer of highly condensed, hydrogen poor hydrocarbons.

A great demand continues for refinery products, particularly gasoline, fuel oils, and gaseous fuels. Because of the shortage of high quality, clean petroleum-type feedstocks, the refiner now must turn to heavier, more hydrogen-deficient, high impurity-containing cracking feedstocks. Included in this category are heavy vacuum gas oils, atmospheric residua, vacuum tower bottoms, and even syncrudes derived from coal, oil shale, and tar sands, and even coal itself.

In some cases, high levels of nitrogen and sulfur constitute a serious problem in such refractory, low-crackability stocks, particularly with reference to downstream processing and product environmental and pollution limitations. An even more difficult problem is posed by the presence of metallic impurities, nickel, vanadium, iron, etc., preserved through geologic time in heavy petroleum fractions. Such metals, commonly associated with porphyrin rings and asphaltenes in high molecular weight cuts, can cause serious engineering-/hardware problems in catalytic cracking. As catalyst is exposed to repeated cycles of reaction/regeneration in a fluid cat cracker (FCC), these metals are absorbed and tend to build up with time and accumulate on the catalyst. They then cause dehydrogenation-type reactions, resulting in formation of very large amounts of coke, large amounts of $H_2$ gas, which may put a severe strain on the FCC unit regenerator air blower and wet gas compressor capacity. Further, and very important, their presence is often associated with a serious loss of conversion and gasoline yield.

SUMMARY OF THE INVENTION

The present invention is concerned with providing mobile hydrogen alone or combined with carbon in molecular fragments in a crystalline zeolite hydrocarbon conversion operation in such amounts that the yield of high quality desired hydrocarbon product will be produced in substantial quantities. In a more particular aspect the present invention is concerned with providing hydrogen contributing materials and/or carbon-hydrogen molecular fragments in a catalytic cracking operation which are lower boiling than a higher molecular weight hydrocarbon charge composition passed to the cracking operation. In yet another aspect the present invention is concerned with providing the hydrocarbon conversion operation with one or more crystalline zeolite conversion catalytic materials which will promote chemical reactions with mobile hydrogen and/or carbon-hydrogen molecular fragments in addition to promoting the catalytic conversion of a raffinate product of residual oil extraction alone or in combination with gas oil fractions to provide useful products contributing to gasoline boiling range material.

In the combination process of this invention large quantities of a "low molecular weight carbon-hydrogen fragment contributing agent or material" and a raffinate product of vacuum tower bottom solvent extraction combined with one or more products of crude oil distillation comprising straight run naphtha, gas oil products of atmospheric and vacuum distillation are converted in the presence of a selective zeolite catalyst with a cracking or acid function. A catalyst suitable for the purpose is a crystalline zeolite catalyst or a combination of zeolite comprising an acid function, which promotes cracking and additive carbon-hydrogen reactions to produce gasoline boiling products in combination with higher and lower boiling products of (a) improved quality and (b) yield superior to that formed in the absence of the "low molecular weight carbon-hydrogen fragment contributing material". The cracking and additive reactions may also occur in the presence of a catalyst with a hydrogen activating and/or hydrogen-transfer function during exposure of the reactant mixture at an elevated temperature to the catalysts herein identified.

A particular advantage of the reaction concepts of this invention is that they occur at low pressures (i.e. at pressures commonly employed in current catalytic cracking operations or slightly higher). It is most preferred that the reactions be performed in fluidized catalyst systems comprising dispersed catalyst phase riser operation alone or in combination with a more dense fluid catalyst bed system. Some relatively dense fluid catalyst phase systems may also be employed with high success.

Some specific advantagees derivable from the improved process concept of this invention include improved crackability of heavy feedstocks, increased gasoline yield and/or gasoline quality (including octane and volatility), and fuel oil fractions of improved yield and/or burning quality and lower levels of potentially poluting impurities such as sulfur and nitrogen. The need for costly high pressure hydrotreaters and hydrocrackers using expensive molecular hydrogen rich gas can thus be eliminated, or the severity requirements of the operation greatly decreased, thus saving considerable capital investment and operating costs.

By "low molecular weight carbon-hydrogen contributing material" is meant materials comprising a lesser number of carbon atoms than found in materials within the gasoline boiling range and preferably those materials containing 5 or less carbon atoms that fit into any of the categories of:

a. Hydrogen-rich molecules, i.e. molecules with wt.% H ranging from about 13.0–25.0 wt.%. This may include light paraffins, i.e. $CH_4$, $C_2H_6$, $C_3H_8$ and other materials.

b. A hydrogen donor molecule, i.e. a molecule whose chemical structure permits or favors intermolecular hydrogen transfer. This includes $CH_3OH$, other low boiling alcohols such as ethanol, n-propanol, isopropanol, n-butanol, isobutanol, etc., aliphatic ethers other oxygen compounds (acetals, aldehydes, ketones) certain sulfur, nitrogen and halogenated compounds. These would include $C_2$–$C_5$ aliphatic mercaptans, disulfides, thioethers, primary, secondary tertiary amines and alkylammonium compounds, and haloalkanes such as methyl chloride etc.

c. Reactants that chemically combine to generate hydrogen donors or "active" or "nascent" hydrogen, i.e. carbon monoxide, CO, especially CO + $H_2O$, CO + $H_2$, CO + alcohol, CO + olefin, etc.

d. Secondary Reaction Products from materials in categories (a), (b), or (c) above that are hydrogen donors themselves, or transfer hydrogen, or become involved in intermolecular hydrogen transfer in which hydrogen redistribution occurs. This includes olefins, naphthenes, or paraffins.

e. Classes of materials which are structurally or chemically equivalent to those of category (d), notably olefins, etc.

f. A combination of any or all of the materials in categories (a) through (e).

g. Preferred low molecular weight materials include methanol and $C_2$–$C_5$ olefins.

By "high molecular weight residual feedstock" is meant any material that boils higher than an atmospheric gas oil and in particular refers to a residual oil of atmospheric and/or vacuum distillation. It is especially preferred that "high molecular weight feedstocks" include vacuum tower bottoms, heavy vacuum gas oils, atmospheric resids and syncrudes from shale oil, tar sands or coal.

By catalyst with a "cracking or acid function" is meant an acidic composition, most preferably a solid, such as a crystalline zeolite cracking catalyst and combinations thereof. The composition includes a crystalline zeolite component (or components) intimately dispersed in a matrix. Zeolites ZSM-5 and ZSM-5 type, mordenite and dealuminized mordenite, TEA mordenite and faujasite type catalyst in combination therewith are preferred.

By catalyst with a "hydrogen-activating function" is meant one of several classes of catalysts which aid in the redistribution or transfer of hydrogen, or which are classified as hydrogen dissociation, hydrogen activation, or hydrogenation catalysts. The catalyst with a "hydrogen-activating function" may or may not contain a metal function. Some of the preferred metal functions are Pt, Ni, Fe, Co, Cr, Th, (or other metal function capable of catalyzing the Fischer-Tropsch or water-gas shift reaction), or Re, W, Mo or other metal function capable of catalyzing olefin disproportionation.

The term "hydrogen transfer" is known in the art of catalytic conversion to characterize the ability to transfer hydrogen other than molecular hydrogen from one type of hydro-carbon to another with a catalyst particularly promoting the transfer. This type of chemical reaction is to be contrasted with hydrogenation catalysts or catalyst components capable of attaching to an olefin from gaseous molecular hydrogen.

A group of highly active catalysts particularly suitable for use in the practice of the present invention are zeolitic crystalline aluminosilicates of either natural or synthetic origin having an ordered crystal structure. These crystalline zeolite materials are possessed with a high surface area per gram and are microporous. The ordered structure gives rise to a definite pore size of several different forms. For example, the crystalline zeolite may comprise one having an average pore size of about 5A such as Linde 5A or chabazite or it may be an erionite or an offretite type of crystalline zeolite. A crystalline zeolite with a pore size in the range of 8-15-A pore size such as a crystalline zeolite of the "X" or "Y" faujasite type of crystalline material may be used. Mordenite and ZSM-5 type of crystalline aluminosilicates may also be employed. In the process of the present invention it is preferred to use crystalline zeolites having a pore size sufficiently large to afford entry and egress of desired reactant molecules. Thus, the catalyst is preferably in part a large pore crystalline zeolite such as an "X" or "Y" faujasite variety or it may be a mixture of large and smaller pore crystalline zeolites. In this regard the mixed crystalline aluminosilicates used in the method of this invention will provide a pore size spread greater than 4 and less than 15 Angstrom units. The small pore zeolite portion of the catalyst may be provided by erionite, offretite, mordenite and ZSM-5 type of crystalline zeolite. Methods of preparing these various crystalline zeolites are the subject of numerous patents now available.

The aluminosililcate active components of the catalyst composite may be varied within relatively wide limits as to the crystalline aluminosilicate employed, cation character, concentration as well as in any added component by precipitation, adsorption and the like. Particularly, important variables of the zeolites employed include the silica-alumina ratio, pore diameter and spatial arrangement of cations.

The crystalline aluminosilicate or crystalline zeolites suitable for use in the present invention is usually modified in activity by dilution with a matrix material of significant or little catalytic activity. It may be one providing a synergistic effect as by large molecule cracking, large pore material and act as a coke sink. Catalytically active inorganic oxide matrix material is particularly desired because of its porosity, attrition resistance and stability under the cracking reaction conditions encountered particularly in a fluid catalyst cracking operation. Inorganic oxide gels suitable for this purpose are fully disclosed in U.S. Pat. No. 3,140,253 issued July 7, 1964 and such disclosure is incorporated herein by reference.

The catalytically active inorganic oxide may be combined with a raw or natural clay, calcined clay, a calcined a clay which has been chemically treated with an acid or an alkali medium or both. The catalyst may also be provided with an amount of iron and/or nickel which materials are known to promote the Fischer-Tropsch reaction. The matrix material is combined with the crystalline aluminosilicate in such proportions that the resulting product contains a minor proportion of up to about 25% by weight of the aluminosilicate material and preferably from about 1% up to about 25 weight percent thereof may be employed in the final composite.

The mobile hydrogen component of the reaction mixture of the present invention may be provided from several different sources, such as the high molecular weight feed and the low molecular weight material, it being preferred to obtain hydrogen moieties from gasiform and vaporous component materials occurring in the operation lower boiling than the hydrocarbon material charged to the cracking operation. Thus, it is proposed to obtain the hydrogen moieties suitable for hydrogen distribution reactions from component and component mixtures selected from thr group comprising methanol, dimethylether, CO and water, carbon monoxide and hydrogen, $CH_3SH$, $CH_3NH_2$, $(CH)_3N$, $(CH)_4N^+A^-$, where $A^-$ is an anion such as a halide, hydroxyl, etc. and $CH_3X$, where X is a halide such as fluorine, bromine, chlorine and iodine. Of these hydrogen contributing materials it is preferred to use methanol alone or in combination with either CO alone, or CO and water together. On the other hand, it is contemplated combining light olefinic gaseous products found in pyrolysis gas and the products of catalytic cracking such as ethylene, propylene and butylene with the hydrogen and/or carbon hydrogen contributing material. In any of these combinations, it is preferred that the mobile hydrogen or the carbon-hydrogen fraction be the product of one or more chemical reactions particularly promoted by a relatively small pore crystalline zeolite such as ZSM-5 type of crystalline zeolite or an intermediate pore size mordenite type zeolite. Methanol is a readily available commodity obtained from CO and $H_2$ synthesis, coal gasification, natural gas conversion, and other known sources.

The current concept employs a fluidized catalyst system at low pressures without the need for high pressure hydrogen gas. Such a system promotes the highly efficient contact of relatively inexpensive hydrogen contributing low molecular weight materials with heavy, refractory molecules in the presence of high-surface area cracking catalyst with or without "hydrogen-activating catalyst functions". Intermolecular hydrogen-transfer interactions and catalytic cracking reactions effected in the presence of fluidized catalyst particles minimize problems due to diffusion mass transport limitations and/or heat transfer.

The concepts of the present invention make use of relatively cheap, low molecular weight carbon-hydrogen contributors comprising $C_3$ to $C_5$ olefin-paraffin mixtures readily available in petroleum refineries, such as light gaseous fractions which are products of the process or available from other sources. It also makes use of methanol, a product which is readily available in quantity, either as a transportable product from overseas natural gas conversion processes, or as a product from large scale coal, shale, or tar sand gasification. It also can utilize carbon monoxide (in combination with hydrogen contributors such as water or methanol), which gas is readily available from refinery regeneration flue gas (or other incomplete combustion processes), or from coal, shale or tar sand gasification. Highly efficient recycle of unused and formed hydrogen contributors is particularly relied upon.

In an operation embodying the concepts of this invention using methanol in combination with a residual oil type of hydrocarbon charge stock or raffinate extract thereof, a ratio of methanol to hydrocarbon charge passed to the cracking operation may vary depending on the charge converted and may be selected from within the range of from about 0.01 to about 5, it being preferred to maintain the ratio within the range of about 0.05 to about 0.30 on a stoichiometric weight basis. However, this may also be varied as a function of the hydrogen deficiency of a raffinate obtained from solvent deasphalting a vacuum tower bottoms, the amount of sulfur, nitrogen and oxygen in the raffinate obtained, the amount of polycyclic aromatics, the catalyst composition employed, and the level of conversion desired. It is preferred to avoid providing any considerable or significant excess of methanol with the charge because of its tendency to react with itself under some conditions.

In a specific embodiment, this invention includes the catalytic conversion of high and low boiling hydrocarbon compositions comprising mixtures of naphtha and raffinate product of solvent extracting the high boiling portion of an asphaltic crude in the presence of carbon-hydrogen fragment contributing materials comprising olefin rich $C_3$ to $C_5$ hydrocarbons in the presence of crystalline zeolite conversion catalysts particularly performing the chemical reactions of cracking, hydrogen redistribution, olefin cyclization and chemical reaction providing mobile hydrogen in one of several different forms and suitable for completing desired hydrogen transfer reactions. The chemical reactions desired are enhanced by the addition of methanol to the feed and promoted by a mixture of large and small pore crystalline zeolites in the presence of hydrogen donor materials such as methanol or a mixture of reactants which will form methanol under, for example, Fischer-Tropsch, or other processing conditions. The conditions of cracking may be narrowly confined within the range of 900° F. to 1200° F. at a hydrocarbon residence time within the range of 0.5 second up to about 5 minutes. The catalyst employed is preferably selected from a rare earth exchanged "X" or "Y" faujasite type crystalline zeolite material alone or in combination with a Mordenite or ZSM-5 type crystalline zeolite, either component of which is employed in an amount within the range of 2 weight percent up to about 15 weight percent dispersed in a suitable matrix material. The faujasite and mordenite crystalline zeolites may be employed alone or in admixture with a ZSM-5 type of crystalline zeolite supported by the same matrix or by a separate silica-clay matrix containing material.

The process combination of the present invention is particularly concerned with separating a crude oil to obtain straight run naphthas, gas oils and a residual oil, separating the residual oil by vacuum distillation to obtain a high molecular weight asphaltic residue which material is solvent extracted with preferably an olefin rich $C_3$ to $C_5$ product of the combination process. The vacuum tower residue will boil in excess of about 1000° F. and comprises undesired components comprising asphaltenes, metal and sulphur contaminants. The raffinate product of solvent extracting the vacuum tower residue may be combined with one or more gas oil products of atmospheric and vacuum tower distillation before effecting solvent extraction thereof. On the other hand, when processing a highly asphaltic crude, the residual oil product of atmospheric distillation may be passed directly to the solvent extraction step thus bypassing the vacuum distillation step of the process.

Propane deasphalting residual oil products of distillation is well known in the prior art. However, the combination process of this invention departs from the known prior art by using olefin rich solvents which are of themselves carbon-hydrogen fragment contributors under relatively high temperature zeolite cracking operations and this solvent can be desirably retained at least in part in intimate admixture and strategic association with the raffinate product of extraction subsequently subjected to the high temperature cracking operation. In this combination, propane is not a particularly desirable solvent since it remains relatively untouched in the cracking operation and thus does not produce the carbon-hydrogen fragments desired by this invention. Thus it is proposed to solvent extract a residual oil relatively high in asphaltenes, metals and sulfur with a $C_3$ to $C_5$ olefin rich product of high temperature zeolite cracking at a temperature in the range of 100° F. to 250° F. and a pressure in the range of 300 to 700 psig to obtain a raffinate product of considerably reduced asphaltene content. The raffinate thus obtained is thereafter flash separated to recover a portion of the solvent from the raffinate. The recovered solvent ($C_3$ to $C_5$ olefin rich) is then passed to a cooling operation of desired pressure wherein its temperature is reduced to about 100° F. before recycle thereof to the solvent extraction step.

In the combination operation of this invention, it is desired to reduce the viscosity of the raffinate product by combining with straight run naphtha separated from the crude charge in the atmospheric distillation zone. Thus the straight run naphtha material comprising $C_5$ up to 380° or 400° F. boiling hydrocarbons, combined with the raffinate of residual oil extraction, assists with obtaining intimate contact of a zeolite cracking catalyst with the raffinate in a riser cracking operation and its presence during the high temperature cracking operation of at least 1000° F. is associated with an improved octane rating in the gasoline product so produced. The riser cracking operation in the presence of a faujasite zeolite cracking catalyst is effected at a temperature within the range of 800° F. to about 1200° F. relying upon a pressure within the range of atmospheric up to 100 or more pounds of pressure. Generally the pressure will be less than 200 psig and the conversion temperature will be about 1000° F. at a hydrocarbon residence time within the range of 0.5 to 10 seconds.

It has been described hereinbefore that the combination operation of this invention is dependent upon the upgrading or conversion of fractions of crude oil by the use of one or more carbon-hydrogen fragment contributors obtained in the high temperature conversion of such combinations with crystalline zeolite conversion catalysts promoting the reactions. Thus the carbon hydrogen fragment producer may be the solvent used to obtain the raffinate oil phase, it may be a separate source of $C_5$- olefinic materials added to the oil charge passed to the riser conversion zone after the solvent extraction step and such olefinic materials may be supplemented in their contribution to the conversion process by the addition of other similar contributors such as methanol.

The hydrocarbon product of the riser cracking operation is separated as herein discussed and a $C_3$ to $C_5$ product fraction of the riser cracking preferably rich in olefin constituents is recovered for recycle to the solvent extraction step discussed. All or a portion of this material may be recycled. On the other hand, since it is olefin rich and suitable for alkylation purposes a substantial portion thereof may be passed to alkylation along with an isobutane product of the combination operation.

BRIEF DESCRIPTION OF THE DRAWING

The drawing is a diagrammatic sketch in elevation of a combination for solvent deasphalting/demetalization and catalytic upgrading of a heavy component fraction of crude oil.

Referring now to the drawing, a crude oil charge introduced by conduit 2 is passed to an atmospheric distillation tower 4 wherein a first separation of the crude oil charge is made in a manner as known in the art. For convenience, tower 4 is shown recovering an overhead fraction by conduit 6 which contain materials boiling below, for example, a heavy naphtha fraction separated and withdrawn by conduit 8. The naphtha recovered by conduit 8 may boil in the range of about 180° to about 400° F. A kerosine boiling fraction is recovered by conduit 10 and a fuel oil-gas oil fraction may be recovered by conduit 12. An atmospheric tower bottoms fraction boiling above about 900° F. is withdrawn by conduit 14 for further processing as herein discussed.

In one embodiment, an atmosphereic tower bottoms of low asphaltene content is used as the charge passed directly to the riser of a fluid catalyst cracking unit. In another arrangement an atmospheric tower bottoms of high asphaltene content is first passed to a vacuum tower 16. A light vacuum gas oil is recovered by conduit 18, a heavy vacuum gas oil is recovered by conduit 20 and a vacuum tower bottoms is recovered by conduit 22. The light and heavy vacuum gas oils may also be used separately or together as charge to a fluid cracking operation such as described below.

In a particular embodiment, the vacuum tower bottoms boiling above 1000° F. and comprising asphaltenes is passed by conduit 22 to a solvent deasphalting zone 24. In zone 24, a cooled solvent stream recovered from zone 38 is admixed with the vacuum tower bottoms to effect a separation of asphalt from the remaining heavy oil charge. Separated asphalt is removed by conduit 26. The raffinate comprising the heavy oil dissolved in solvent is passed by conduit 28 to a flash zone 30 wherein a portion of the solvent is separated from the raffinate for recycle to the solvent extraction step. The temperature and pressure of flash zone 30 are selected to regulate the ratio of solvent retained by the heavy oil in a desired amount. The flashed solvent is passed by conduit 32 to cooler 34 and thence by conduit 36 to cooling unit 38. The raffinate is removed from zone 30 by conduit 40 communicating with the riser conversion zone of a fluid catalyst cracking unit more fully discussed herein. Conduit 42 is provided for passing atmospheric tower bottoms from conduit 14 directly to conduit 40 and thence to the riser reactor 48 thereby bypassing vacuum tower 16 and the solvent deasphalting zone 24 discussed above.

A low molecular weight carbon-hydrogen fragment contributor such as methanol and/or $C_5$ minus gasiform material which may be primarily olefinic is introduced by conduit 44 combined with the heavy oil feed in conduit 40. The mixture is then heated as by a furnace 46 or other suitable means to an elevated temperature up to about 800° F. before contact is made with hot regenerated catalyst introduced to the bottom of riser 48 by conduit 50 to form a suspension at a temperature within the range of 900° F. to about 1100° F. The hot regenerated catalyst introduced to the lower portion of the riser by conduit 50 may be at a temperature of about 1350° F. In riser 48, a high temperature short contact time (0.5–10 seconds) riser conversion operation is maintained for converting the heavy oil charge to gasoline as well as lower and higher boiling components in the presence of a zeolite cracking catalyst.

The catalyst employed may be a faujasite crystalline zeolite type material, a ZSM-5 type crystalline zeolite, a dealuminized mordenite type crystalline zeolite and mixtures thereof.

The suspension formed as above provided is passed upwardly through the riser conversion zone 48 for discharge into one or more cyclonic separators represented by separator 52 wherein a separation is made between particles of catalyst and vaporous materials.

The separated catalyst is collected as bed 54 which is stripped of entrained vaporous products by gaseous material introduced by conduit 56. The stripped catalyst is passed by conduit 58 to a catalyst regeneration zone 60 wherein carbonaceous deposits are removed by burning in the presence of an oxygen containing regeneration gas such as air or oxygen modified air introduced by conduit 62.

The vaporous products of the riser cracking operation are passed by conduit 64 to a fractionator or distillation zone 66. In distillation zone 66, a separation is made to recover a clarified slurry oil (CSO) removed from the bottom of the distillation zone by conduit 68. A heavy cycle oil is withdrawn by conduit 70, a light cycle oil is withdrawn by conduit 72 and a heavy naphtha fraction is withdrawn by conduit 74. An overhead fraction is withdrawn by conduit 76 for passage to cooler 78 wherein the temperature of the overhead is reduced to about 100° F. The cooled overhead is then passed by conduit 80 to accumulator drum 82. In drum 82, a phase separation is made into a vaporous phase and a liquid phase at a temperature of about 100° F. The liquid is withdrawn by conduit 84 and a portion thereof is recycled to the tower 66 as reflux by conduit 86. The remaining portion of the condensed liquid is passed by conduit 88 to an accumulator drum 90. Vaporous material removed by conduit 92 is passed by compressor 94 and conduit 96 to accumulator drum 90 maintained at a temperature of 100° F. and a pressure of about 200 psig. In drum 90 a rough separation is made to separate a light naphtha fraction boiling below about 320° F. at its 90 percent ASTM boiling point from lower boiling vaporous material comprising primarily $C_4$ minus material. The light naphtha is recovered by conduit 98 and passed to a light ends recovery represented by box 102. The vaporous material is passed by conduit 100 to a light ends separation and recovery operation also represented by box 102.

In the light ends separation operation, $C_2$ and lighter materials are separated and recovered as by conduit 104. $C_3$ olefins and saturated $C_3$ components are separated and recovered by conduit 106 with $C_4$+$C_5$ olefins and saturated components thereof recovered by conduit 108. A naphtha fraction boiling from about 90° F. to 320° F. as above identified, is recovered by conduit 109 and passed to storage or further processing not shown.

In the combination operation of this invention the $C_3$ to $C_5$ products of the cracking operation are combined and used for alkylation, recycle to the riser reactor or a portion thereof is passed by conduit 110 to refrigeration unit 38. Other sources of $C_3$ to $C_5$ olefins and/or paraffins may be added to the process by conduit 112. Thus as discussed above the $C_3$ to $C_5$ gasiform products of the cracking operation separated in zone 102 are employed after suitable cooling and pressuring thereof for use in solvent deasphalting of the heavy oil charge before processing the deasphalting feed in the cracking operation. In the combination operation herein discussed, it has been found particularly desirable to rely upon an olefin rich solvent material comprising $C_5$ and ligher materials which convert to desired carbon-hydrogen fragments in the cracking operation subsequently performed. It has also been noted that the virgin naphtha component combined with the crude oil charge and comprising material boiling in the range of 180° to 380° F. is associated with producing a relatively high octane product during the riser cracking operation. It can be accomplished separately or in combination with the solvent recovered low asphalt containing feed combined with a low molecular weight carbon hydrogen fragment contributor discussed herein. Thus all or a portion of the heavy straight run naphtha withdrawn from the crude oil atmospheric distillation 4 as by conduit 8 may be passed all or in part by conduit 114 for admixture with the solvent recovered oil charge or raffinate in conduit 40. Also the straight run naphtha may be passed in part by conduit 116 to a catalytic reforming operation not shown or a separate riser reactor conversion zone as above provided but not shown for octane improvement with a zeolite catalyst. It is preferred, however, to process the naphtha combined with carbon-hydrogen contributor either alone or in part with the solvent recovered heavy charge oil in a high temperature riser cracking operation to improve contact between oil charge and catalyst particles during conversion thereof in the presence of crystalline zeolite catalytic material herein defined.

The gas oil or light fuel oil fraction recovered from tower 4 by conduit 12 may be sent to storage and further use as desired or it may be passed by conduit 42 directly to the solvent deasphalting unit 24 for admixture with the vacuum tower bottoms passed by conduit 22.

DISCUSSION OF SPECIFIC EMBODIMENTS

The combination operation of the present invention was found to be an effective method for upgrading residual materials as evidenced by the following examples.

A composite feedstock comprising 80 parts by weight of Arab Light propane deasphalting raffinate and 20 parts by weight of naphthenic naphtha was prepared. Identification and inspections for these two components are provided in Table 5 below. The composite feed (s.g. 60° F. = 0.9022) was prepared because the propane deasphalted (PDA) raffinate was too heavy and waxy by itself to flow properly and freely in test equipment. The composite feed was combined with 1-butene (79.1 weight percent based on PDA raffinate) to form a blend which was pumped to a feed preheater of a 30 foot riser fluid catalyst test reactor. The blend was intimately mixed in the preheater at 790° F. and then brought in contact with hot catalyst (1082° F.) in the riser reactor inlet. The catalyst was a 15% REY (rare earth exchange "Y" faujasite crystalline zeolite containing catalyst, 67.5 FAI) which had been burned white. The riser reactor inlet mix temperature of the feed-catalyst suspension formed was 1000° F., ration of catalyst to composite feed comprising 1-butene carbon-hydrogen fragment contributor was 10:20 to 1, catalyst residence time within the riser was determined as 3.86 seconds, the riser inlet pressure was 30 psig and the ratio of catalyst residence time to feed residence time provided a catalyst slip factor of about 1.24. The riser effluent was separated into a hydrocarbon phase and a catalyst phase. The catalyst contained 0.586 weight percent carbon. The catalyst was stripped and gasiform material comprising the separated hydrocarbon phase was separated by distillation and analyzed. Data obtained under the above identified operating conditions are identified as run number H-685. The data obtained including mass balance gasoline inspections, cycle oil inspections and feed stock inspection are presented in Tables 1, 2, 3, 4 and 5 respectively.

A control run H-684 is provided for comparison which was processed under similar conditions but in the absence of 1-butene as a carbon-hydrogen fragment contributor.

Table 1

CONVERSION OF ARAB LIGHT PROPANE DEASPHALTED RAFFINATE W/WO 1-BUTENE OVER ZEOLITE CATALYST

| Reaction Conditions | H-684 | H-685 |
|---|---|---|
| Reactor Inlet Temp., °F. | 1000 | 1000 |
| Oil Feed Temp., °F. | 790 | 790 |
| Catalyst Inlet Temp., °F. | 1113 | 1082[a] |
| Catalyst/Oil (wt/wt) Ratio | 8.05 | 10.20 |
| Catalyst Residence Time | 4.90 | 3.86 |
| Reactor Inlet Pressure, psig. | 30 | 30 |
| Moles of Product/Mole Feed (ex coke) | 3.349 | 1.715 |
| Oil Partial Pressure, Inlet psia | 26.3 | 36.0 |
| $T_{mix}$ °F. | 1004 | 1009 |
| Carbon, Spent Catalyst, % wt. | 0.627 | 0.586 |
| Slip Ratio | 1.24 | 1.24 |
| Co-cracking Agent | — | 1-Butene |
| Co-cracking Agent, wt.-% of Oil feed | — | 79.1 |
| Molar Ratio, Co-cracking Agent/Oil Feed | — | 4.93 |
| Catalyst | ←15% REY→ Burned White, FAI = 67.5 | |

[a]Based on both oil plus 1-butene

Table 2

Product Selectivities (Basis = 100 g Oil Charge Feed)

| Run | H-684 | H-685 |
|---|---|---|
| Charge In | | |
| Oil charge, g. | 100.0 | 100.0 |
| 1-Butene, g. | — | 81.1 |
| Total, g. | 100.0 | 181.1 |
| Products Out, g. | | |
| $C_5$ + Gasoline[a] | 55.43 | 63.35 |
| Total $C_4$ | 12.37 | 74.61 |
| Dry Gas | 9.90 | 15.83 |
| Coke | 5.49 | 11.77 |
| Cycle Oil[a] | 16.81 | 15.52 |
| Light Product Breakdown,g. | | |
| $H_2S$ | 0.69 | 0.53 |
| $H_2$ | 0.04 | 0.09 |
| $C_1$ | 0.99 | 1.58 |
| $C_2$= | 0.88 | 1.49 |
| $C_2$ | 0.75 | 1.14 |
| $C_3$= | 4.46 | 8.96 |
| $C_3$ | 2.08 | 2.05 |
| $C_4$= | 4.46 | 51.38 |
| i-$C_4$ | 6.35 | 11.72 |
| n-$C_4$ | 1.56 | 11.54 |
| $C_5$= | 1.95 | 1.78 |
| i-$C_5$ | 6.41 | 8.29 |
| n-$C_5$ | 1.07 | 1.12 |
| Recovery, wt.% of feed | 97.36 | 108.2 |
| $H_2$-Factor | 19 | 14 |
| Gasoline Efficiency, Apparent[b] | 66.6 | 75.0 |

[a]~ 356°F. at 90% ASTM cut point.
[b]Defined here as g. gasoline/100 g. oil − g. cycle oil × 100.

Table 3

GASOLINE INSPECTIONS

| | Run H-684 | Run H-685 |
|---|---|---|
| Sp. Grav., 60°F. | 0.7411 | 0.7220 |
| API Grav., 60°F. | 59.4 | 64.5 |
| $C_5$ + Sp. Grav., 60°F.,calc'd. | 0.7505 | 0.7386 |
| R + 0 Octane No., Raw | 90.3 | >94 |
| Hydrocarbon Type, $C_5$-Free, Vol.% | | |
| Paraffins | 34.6 | 32.4 |
| Olefins | 8.0 | 9.5 |
| Naphthenes | 17.5 | 15.1 |
| Aromatics | 39.7 | 43.1 |
| Gasoline, wt.% $H_2$ | 12.62 | 12.49 |

Table 3-continued

GASOLINE INSPECTIONS

| | Run H-684 | Run H-685 |
|---|---|---|
| Distillation, °F. | | |
| 10% | 84 | |
| 50% | 272 | |
| 90% | 368 | |

Table 4

CYCLE OIL INSPECTIONS

| | Run H-684 | Run H-685 |
|---|---|---|
| Sp. Grav., 60°F. | 1.0428 | 1.0505 |
| API Gravity, 60°F. | 4.2 | 3.2 |
| Sulfur, % Wt. | — | — |
| Hydrogen, % Wt. | 7.82 | 7.81 |
| RI, 70°C. | 1.595 | 1.599 |
| Hydrocarbon Type, Wt.% | | |
| Paraffins | 28 | — |
| Mono-naphthenes | 0.7 | — |
| Poly-naphthenes | 1.5 | — |
| Aromatics | 95.0 | — |
| Distillation, °F. | | |
| 10% | 440 | 442 |
| 50% | 529 | 547 |
| 90% | 745 | 752 |
| Aromatic Breakdown, Normalized, Wt.% | | |
| Mono-aromatics | 7.3 | — |
| Di-aromatics | 48.0 | — |
| Tri-aromatics | 15.0 | — |
| Tetra-aromatics | 8.8 | — |
| Penta-aromatics | 1.6 | — |
| Sulfur Compounds | | |
| Benzothiophenes | 9.7 | — |
| Dibenzothiophenes | 7.3 | — |
| Naphthobenzothiophenes | 2.3 | — |
| Other | 0 | — |
| Ratio, Diaromatics/Benzothiophene | 4.95 | — |

Table 5

INSPECTIONS[b], 650°F. + ARAB LIGHT PDA RAFFINATE AND COASTAL NAPHTHA (ST. RUN)

| Description | Arab Lt. PDA Raffinate | Coastal Naphtha[a] |
|---|---|---|
| Physical Properties | | |
| Gravity °API at 60°F. | 20.8 | 40.9 |
| Sp. Gravity at 60°F. | 0.9291 | .8207 |
| Carbon Residue, CCR, Wt.% | 2.11 | — |
| Retractive Index, 70°F. | 1.49684 | — |
| Molecular Weight | 685 | 118 |
| Chemical Analyses | | |
| Hydrogen, % Wt. | 12.25 | 13.65 |
| Sulfur, % Wt. | 2.193 | — |
| Nitrogen, % Wt. | .066 | — |
| Basic Nitrogen, ppm | 239 | — |
| Metals, ppm | | |
| Nickel | 0.5 | — |
| Vanadium | 1.0 | — |
| Copper | 1.2 | — |
| Iron | 0.3 | — |
| Molecular Type, wt.% | | |
| Paraffins | 15.7 | 15.1 |
| Naphthenes | 33.2 | 72.5 |
| Aromatics | 51.2 | 12.1 |
| Distillation (type) | D-1160 | ASTM |
| IBP | 744 | 290 |
| 5 Vol.%, °F. | 900 | 310 |
| 10 Vol.%, °F. | 940 | 314 |
| 20 Vol.%, °F. | 973 | 320 |
| 30 Vol.%, ° F. | 1014 | 332 |
| 50 Vol.%, °F. | 1026 | 337 |
| 60 Vol.%, °F. | | 342 |
| 70 Vol.%, °F. | | 348 |
| 80 Vol.%, °F. | | 356 |
| 90 Vol.%, °F. | | 369 |
| 95 Vol.%, °F. | | |

Table 5-continued

| INSPECTIONS[b], 650°F. + ARAB LIGHT PDA RAFFINATE AND COASTAL NAPHTHA (ST. RUN) | | |
|---|---|---|
| Description | Arab Lt. PDA Raffinate | Coastal Naphtha[a] |
| FP | | 408 |

[a]R+O Octane = 61.1

[b]For composite feed of PDA raffinate plus naphtha, the weight percent hydrogen (calc.) is 12.53.

An evaluation of the data presented in the tables above show the following improvements when using 1-butene in the feed composite during zeolite cracking thereof. It will be observed from Table 2 that run H-685 accomplished in the presence of 1-butene provided significantly improved $C_5$+ gasoline yields (Δ improvement = 7.92 wt.%) of which 22% improvement is obtained from the $C_5$'s with the preponderance thereof comprising 78% consisting of $C_6$+ gasoline. In addition the gasoline efficiency was improved by 8.4% (wt. basis) and the gasoline quality was improved. That is, mass spectroscopic "PONA" hydrocarbon-type analysis shows there were obtained fewer paraffins and naphthenes, slightly more olefins and more aromatics as follows:

| Hydrocarbon Type | Δ, vol.% |
|---|---|
| P | −2.2 |
| O | +1.5 |
| N | −2.4 |
| A | +3.4 |

From the gasoline inspection data of Table 3, it will be observed that there is a significant improvement in octane number, greater than 94.0 R+0 (Research Clear) for the conversion operation in the presence of 1-butene olefin and about 90.3 R+0 (Research Clear) without 1-butene carbon-hydrogen fragment contributor with the feed. Thus a delta, Δ, octane improvement of 3.70 R+0 units was obtained. The improved octane number is reflected in the more hydrogen deficient gasoline formed with the olefin (1-butene) cocracking operation (12.49% $H_2$) vs (12.62% $H_2$) without 1-butene. Note also that the R+0 octane number of the coastal naphtha used to form the composite feed was determined as 61.10.

In addition to the above, the conversion operation in the presence of 1-butene produced slightly more ethylene (+ 0.61 wt.%) and significantly more propylene (+ 4.5 wt.%). These materials are useful as feed to an alkylation unit. On the other hand, a large increase in isobutane (+ 5.37 wt.%) was also obtained in the combination operation. This material also is useful in alkylation and is particularly desirable in an isobutane short refinery operation. Any excess butenes formed in the operation are recycled in the combination operation above described and n-butane formed in the process is used to vapor pressure adjust gasoline product, used for LPG and/or isomerized to isobutane. It also is to be noted from the data of Table 2, that the yield of propane is substantially the same in each run. Also the cycle oils shown in Table 4 are of comparable quality.

Having thus generally described the invention and discussed specific examples in support thereof, it is to be understood that no undue restrictions are to be imposed by reason thereof except as defined by the following claims.

We claim:

1. A method for upgrading residual hydrocarbons comprising asphaltenes which comprises solvent extracting a residual hydrocarbon with a mixture of $C_3$ to $C_5$ olefins under conditions to remove asphaltic material from a lower boiling hydrocarbon phase comprising said $C_3$ to $C_5$ olefins, separating a portion of the solvent olefins from the lower boiling phase for recycle to said solvent extraction step, combining the lower boiling hydrocarbon phase of reduced solvent olefins with additional low molecular weight carbon-hydrogen fragment contributing material and passing the mixture thus formed in contact with a fluid zeolite cracking catalyst in a riser conversion cracking zone, separating the product of the cracking operation to recover a mixture comprising $C_3$ to $C_5$ olefins and passing a portion of the olefins thus recovered to said solvent extraction step.

2. The method of claim 1 wherein the residual hydrocarbon is a product of vacuum tower distillation.

3. The method of claim 1 wherein the residual hydrocarbon is a product of atmospheric tower distillation.

4. The method of claim 1 wherein a straight run naphtha is combined with the lower boiling hydrocarbon phase passed to the cracking operation.

5. The method of claim 1 wherein a gas oil product of atmospheric distillation is combined with the lower boiling hydrocarbon phase charged to the cracking operation.

6. The method of claim 1 wherein the catalyst employed in the fluid cracking operation is a dual component crystalline zeolite of large and small pore size.

7. The method of claim 1 wherein the fluid cracking catalyst comprises a rare earth exchange "Y" faujasite crystalline zeolite.

8. The method of claim 1 wherein the cracking catalyst comprises ZSM-5.

9. The method of claim 1 wherein methanol is combined with the lower boiling hydrocarbon phase passed to the riser cracking operation.

10. The method of claim 1 wherein gas oil products of atmospheric and vacuum distillation are combined with the lower boiling hydrocarbon phase passed to the cracking operation.

* * * * *

UNITED STATES PATENT AND TRADEMARK OFFICE

CERTIFICATE OF CORRECTION

PATENT NO. : 3,951,781

DATED : April 20, 1976

INVENTOR(S) : HARTLEY OWEN and PAUL B. VENUTO

It is certified that error appears in the above-identified patent and that said Letters Patent are hereby corrected as shown below:

| | |
|---|---|
| Column 1, line 45 | "absorbed" should be -- adsorbed -- |
| Column 2, line 41 | "advantagees" should be -- advantages -- |
| Column 3, line 58 | "attaching to" should be -- attaching hydrogen to -- |
| Column 4, line 22 | "aluminosililcate" should be --aluminosilicate-- |
| Column 4, line 67 | "thr" should be -- the -- |
| Column 6, line 42 | "comprises" should be -- comprise -- |
| Column 9, line 58 | "deasphalting" should be -- deasphalted -- |
| Column 10, line 52 | "ration" should be -- ratio -- |
| Column 14, lines 27 and 28 | "with a fluid zeolite cracking catalyst in a riser conversion cracking zone" should be -- with a riser conversion fluid zeolite cracking catalyst in a cracking zone, -- |

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*